US005936530A

United States Patent [19]

Meinhold

[11] Patent Number: 5,936,530

[45] Date of Patent: Aug. 10, 1999

[54] CHILD PROTECTION DEVICE

[76] Inventor: Robert C. Meinhold, 7 Padden Rd., Franklin, Mass. 02038

[21] Appl. No.: 09/054,187

[22] Filed: Apr. 2, 1998

[51] Int. Cl.[6] ..... G08B 21/00

[52] U.S. Cl. ..... 340/573.1; 340/539; 340/693.5; 340/693.9

[58] Field of Search ..... 340/573, 531, 340/539, 693, 573.1, 693.9, 693.5

[56] References Cited

U.S. PATENT DOCUMENTS

| | | | |
|---|---|---|---|
| 5,337,041 | 8/1994 | Friedman | 340/539 |
| 5,357,254 | 10/1994 | Kah, Jr. | 342/42 |
| 5,423,574 | 6/1995 | Forte-Pathroff | 283/75 |
| 5,471,199 | 11/1995 | Yuan | 340/693 |
| 5,557,259 | 9/1996 | Musa | 340/573.4 |
| 5,617,074 | 4/1997 | White | 340/573.4 |
| 5,640,147 | 6/1997 | Chek et al. | 340/573 |
| 5,646,593 | 7/1997 | Hughes et al. | 340/573.1 |
| 5,661,459 | 8/1997 | Belcher | 340/573.4 |
| 5,661,460 | 8/1997 | Sallen et al. | 340/573.4 |
| 5,689,240 | 11/1997 | Traxler | 340/573 |

*Primary Examiner*—Glen Swann
*Attorney, Agent, or Firm*—Kriegsman & Kriegsman

[57] ABSTRACT

A child protection device has in one embodiment an alarm unit which includes a casing, a receiver disposed in the casing for detecting a system-enabling signal remotely transmitted, a battery in the casing for powering the receiver, and a speaker disposed in the casing in electrical connection with the receiver for emitting a siren in response to the receiver is detecting the system-enabling signal. The child protection device also has a strap attached to the casing for affixing the child protection device onto a child, the strap being constructed of a strong, durable and unbreakable material and a lock for locking the strap in place on the child. In one version, the strap is sized and shaped so as to enable the child protection device to be worn as a bracelet on the wrist of the child. In another version, the strap is sized and shaped so as to enable the child protection device to be worn as a harness on the torso of the child.

14 Claims, 3 Drawing Sheets

CHILD PROTECTION DEVICE

BACKGROUND OF THE INVENTION

The present invention relates generally to monitoring systems and, more particularly, is directed to systems directed to the monitoring of a child.

Often a child will become separated from a supervising individual. The separation of a child and a supervising individual can pose a serious threat to the safety and well-being of the child. As a consequence, there exists a demand for a child protection system which aids in preventing a child from being separated from his/her guardian.

Accordingly, child monitoring systems are well-known and are commonly used in the art to monitor the location of a child.

One type of child monitoring system operates as a radio beacon detector which monitors the separation distance between a guardian and a child. If the distance between the guardian and the child exceeds a predetermined range, an alarm condition is established.

In U.S. Pat. No. 5,689,240 to N. B. Traxler, which patent is incorporated herein by reference, there is disclosed a child monitor system that transmits and receives signals comprising a master unit and a remote unit, wherein a separation distance between the master unit and remote unit is continuously monitored and an alarm is activated on the master unit when no signal is received from the remote unit for at least a time longer than a preset interval. If the separation distance between the master and remote unit is exceeded for a time longer than a preset time interval, the remote unit activates an alarm attached to the remote unit. The master unit may also be used to activate manually the remote unit's alarm. A pin or key arrangement is provided that ensures that the remote unit is not deactivated without interfacing with the master unit.

In U.S. Pat. No. 5,646,593 to M. Hughes et al, which patent is incorporated herein by reference, there is disclosed a child proximity detection unit that includes two transceivers which communicate messages with one another.

In U.S. Pat. No. 5,617,074 to M. D. White, which patent is incorporated herein by reference, there is disclosed a child finder that basically consists of a transmitter which is concealingly attachable to a child's body and which sends a signal to a conventional receiver so that the child's location can be continually monitored. The transmitter will typically be carried in an article of jewelry, such as a watch, bracelet, ring, or the like, and will use a special on/off switch which allows the transmitter to be activated only when the jewelry is being worn by the child. The switch includes a reciprocal push button which closes the transmitter's electrical circuit when depressed, and the button is spring-biasedly moved away from electrical contact with the transmitter's circuit when the article of jewelry is not being worn. To protect against inadvertent partial movement of the button which could break electrical contact thus deactivating the transmitter an electrical contact surface of the button is provided with an upwardly extending electrically conductive spring finger which maintains continual electrical contact irrespective of temporary and inadvertent reciprocal movement of the push button. When the push button is totally depressed, the spring finger recedes into a provided groove on the electrical contact surface of the button so as to prevent the finger from causing interference between the primary electrical contact surfaces.

Another type of child monitoring system operates as a remote controlled device which alarms passersby of the separation of a guardian and a child. Specifically, the guardian typically has a transmitter which, when activated, sends out an encoded radio signal. The child is typically wearing a monitoring unit which detects the encoded radio signal and, in turn, activates a loud siren. The siren notifies passerbys that the child has been separated from the parent and/or that the child is accompanying an unauthorized individual.

In U.S. Pat. No. 5,640,147 to L. Chek et al., which patent is incorporated herein by reference, there is disclosed a system for monitoring the activity of a child comprising a monitoring and control means for transmitting at least one system-enabling signal and for receiving audio signals; and a child-mountable means for transmitting in response to the receipt of at least one of said system-enabling signals any audio detected in the immediate proximity to said child.

Other patents of interest include U.S. Pat. No. 5,661,460 to Inventor Sallen et al. which issued on Aug. 26, 1997, U.S. Pat. No. 5,661,459 to Inventor Belcher which issued on Aug. 26, 1997, U.S. Pat. No. 5,557,259 to Inventor Musa which issued on Sep. 17, 1996, U.S. Pat. No. 5,423,574 to Inventor Forte-Pathroff which issued on Jun. 13, 1995 and U.S. Pat. No. 5,357,254 to Inventor Kah, Jr. which issued on Oct. 18, 1994, all of which patents are hereby incorporated by reference.

Child monitoring systems as described above typically suffer from at least one of the following drawbacks.

As a first drawback, child monitoring devices are typically constructed as a bracelet or belt which can be easily fit onto and removed off of a child. Accordingly, it has been found that any unauthorized adult can easily remove the device from the child and thereby eliminate its usefulness.

As a second drawback, child monitoring devices are typically remotely controlled using radio frequency signals. Accordingly, it has been found that radio frequency signals have a limited range and thereby restrict the use of such a device to those instances in which the child is relatively close to the guardian.

SUMMARY OF THE INVENTION

It is an object of the present invention to provide a new and improved child protection device.

It is another object of the present invention to provide a child protection device which can be fitted onto a child.

It is yet another object of the present invention to provide a child protection device of the type described above which cannot be easily removed from the child or easily tampered with by an unauthorized person.

It is still another object of the present invention to provide a child protection device of the type described above which includes a receiver for detecting a system-enabling signal remotely transmitted through a communication medium.

It is another object of the present invention to provide a child protection device of the type described above wherein the system-enabling signal is capable of being remotely transmitted a large distance through the communication medium.

It is yet another object of the present invention to provide a child protection device as described above which has a limited number of parts, which is inexpensive to manufacture and which is easy to use.

Accordingly, there is provided a child protection device, said child protection device comprising an alarm unit and strap means, the alarm unit comprising a casing, a receiver disposed in said casing for detecting a system-enabling signal remotely transmitted through a communication medium, a battery in the casing for powering the receiver, and a signal emitter disposed in said casing in electrical connection with said receiver for emitting an alarm signal in response to said receiver detecting the system-enabling signal, said strap means including a strap fixedly attached to said alarm casing for affixing said child protection device onto the child, said strap being constructed of a strong, durable and unbreakable material, said strap means further including a locking mechanism for locking said strap in place on the child.

The communication medium may either be a direct wireless connection, a cellular phone type connection or a landline wire connection.

Various other features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

A fuller understanding of the nature and objects of the present invention will become apparent upon consideration of the following detailed description taken in connection with the accompanying drawings, wherein like reference numerals represent like parts.

DETAILED DESCRIPTION OF THE PREFERRED EMBODIMENT

Figure 1:
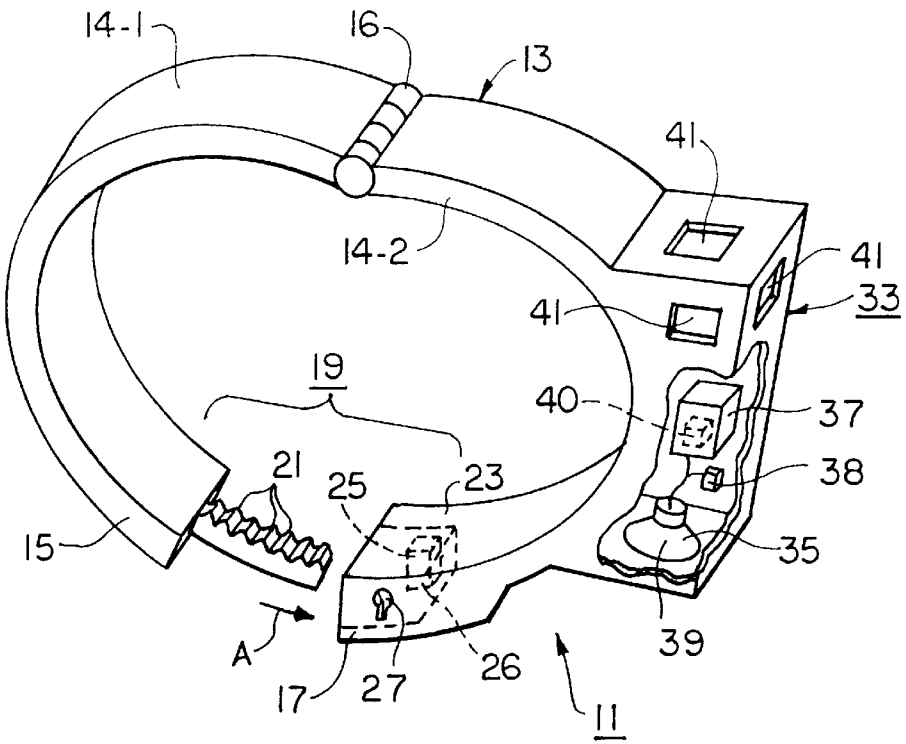
FIG. 1 is a perspective view, broken away in part, of a first embodiment of a child protection device constructed according to the teachings of the present invention.

Referring now to FIG. 1, there is shown a first embodiment of a child protection device constructed according to the teachings of the present invention, the child protection device being identified generally by reference numeral 11. As will be discussed in detail below, child protection device 11 enables a guardian to effectively monitor the location of a child C.

Child protection device 11 comprises a security strap 13 having a first portion 14-1, which includes first end 15, and a second portion 14-2, which includes a second end 17. Security strap 13 is of a size, shape and length which enables it to be wrapped around the wrist of child C. However, it is to be understood that strap 13 could alternatively be constructed as a belt, anklet, collar, necklace or other similar structure that is to be worn elsewhere on child C without departing from the spirit of the present invention. Security strap 13 is constructed of a strong, durable and unbreakable material, such as metal, a metal alloy, graphite, plastic or other similar material that is resistant to being cut or broken using scissors, shears, a hacksaw or the like. First portion 14-1 of strap 13 is connected to second portion 14-2 of strap 13 by a hinge 16. If strap 13 is a flexible material, hinge 16 could be omitted.

Child protection device 11 further comprises a locking mechanism 19 for lockably connecting first end 15 of strap 13 to second end 17, locking mechanism 19 being designed so as to prevent the unauthorized removal of security strap 13 from around the wrist of monitored child C. In the present embodiment, locking mechanism 19 includes a plurality of adjustment ratchet teeth 21 which are integrally formed on first end 15 of strap 13 and an adjustment receptacle 23 which is formed on second end 17 of strap 13. To lockably adjust child protection device 11 around the wrist of child C, first end 15 of security strap 13 is fed into an elongated slot 25 formed in adjustment receptacle 23. With first end 15 fed into elongated slot 25 in the direction represented by arrow A, adjustment ratchet teeth 21 engage a pivotally mounted latch 26 formed within receptacle 23 which precludes first end 15 from being withdrawn from adjustment receptacle 23 in the opposite direction of arrow A. Adjustment ratchet teeth 21 are sized and shaped to enable first end 15 to be advanced into slot 25 of receptacle 23 and thereby enable strap 13 to be adjustably wrapped snugly around the wrist of child C.

A keyed slot 27 is formed in adjustment receptacle 23. Keyed slot 27 is sized and shaped to enable a key (not shown), which is preferably in the possession of the guardian at all times, to be inserted into receptacle 23. When inserted into keyed slot 27, the key can be turned in order to disengage adjustment ratchet teeth 21 from the internal latch, thereby enabling first end 15 to be withdrawn from receptacle 23. It should be noted that the key serves as the only means for child protection device 11 to be removed from the wrist of child C. Instead of a key operated adjustment receptacle 23, the adjustment receptacle could be a combination lock type receptacle or any other type of mechanical, electromechanical or equivalent type of lock.

Instead of ratchet teeth 21 on first end 15 of strap 13, a series of holes could be formed on first end 15 of strap 13.

Child protection device 11 further includes an alarm unit 33 for receiving a system enabling signal and emitting an audio signal in response thereto. Alarm unit 33 comprises a generally rectangular casing 35 fixedly mounted (by any suitable means, not shown) on security strap 13, a receiver 37 disposed within casing 35 for detecting an encoded, system-enabling signal, a 9 volt battery 38 for powering receiver 37 and a speaker 39 disposed within casing 35 in electrical connection with receiver 37 for emitting a loud recognizable siren in response to receiver 37 detecting the system-enabling signal. Casing 35 includes a plurality of open slots 41 through which sound produced by speaker 39 can pass, thereby limiting the amount in which casing 35 muffles sound produced by speaker 39. Receiver 37 includes a microprocessor 40.

Receiver 37, battery 38 and speaker 39 are all made waterproof, by any suitable means known in the art.

Figure 2:
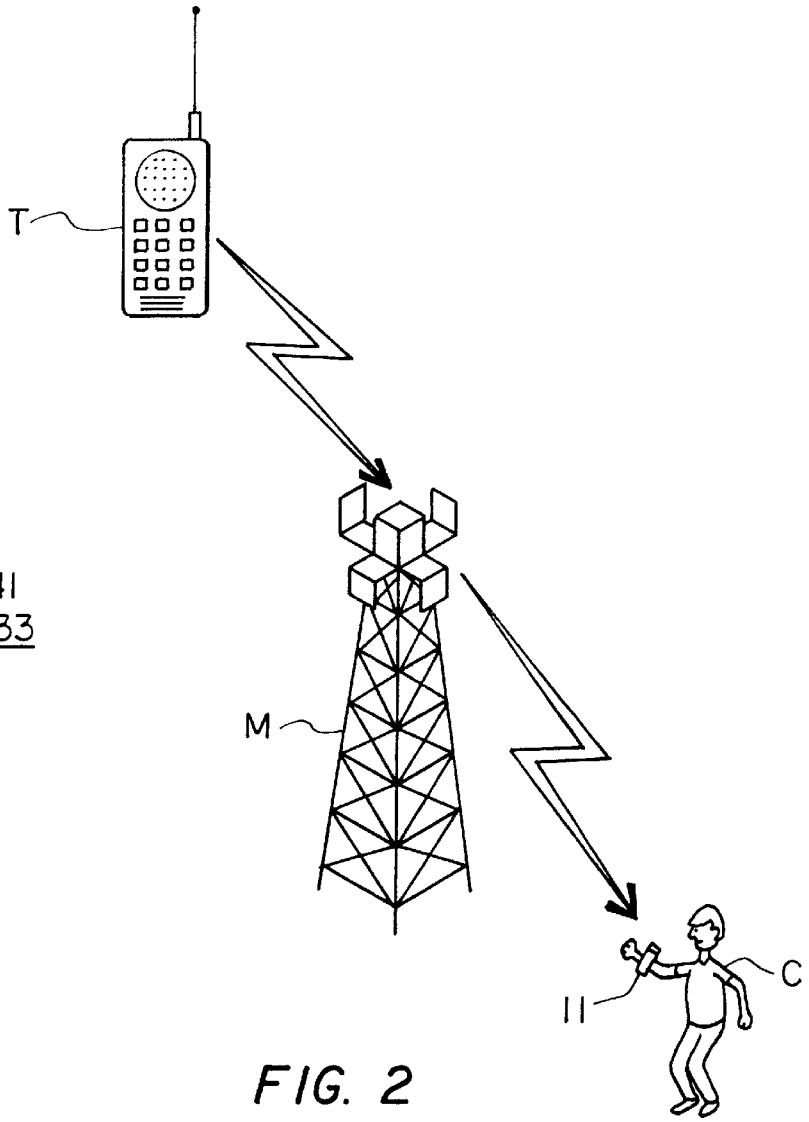
FIG. 2 is a system overview of how the child protection device shown in FIG. 1 could be remotely enabled using a telephone.

As shown in FIG. 2, device 11 is of the type which can detect a system-enabling signal that has been remotely transmitted by a telephone T through a cellular communication medium M of the type commonly used in conjunction with cellular telephones and pagers. As will be described further in detail below, receiver 37 in device 11 is of the type which can be accessed by first dialing a predetermined pager number and then enabled by dialing a predetermined activation code.

It should be noted that child protection device 11 is not limited to the use of cellular communication medium M to remotely transmit the system-enabling signal. Possible alternative communication mediums which may be used to remotely transmit the system-enabling signal include a direct wireless connection and a landline telephone wire connection and may comprise code division multiple access means, time division multiple access means, advanced mobile phone service means, total access communications system means, global system means for mobile communications, personal communication services means and cellular digital packet data means. The signal transmitted may be any type of electromagnetic radiation including RF and light.

Alarm speaker 39 emits a loud recognizable siren, approximately 120 decibels at peak, upon detection of the system-enabling signal by receiver 37 to facilitate locating the child and/or notify passerbys that the child is not accompanying an authorized guardian. It should be noted that child protection device 11 could be constructed so that the sound level of the siren for speaker 39 can be remotely increased or decreased using telephone T to help in locating the child. Also, instead of the sound level being controlled by telephone T, device 11 could be programmed so that the sound level increases automatically in time (i.e. increase in volume every 30 seconds or other predetermined time intervals). It should also be noted that speaker 39 could be alternatively constructed so as to emit an alarm signal which is inaudible to the human ear but which permits the tracking the location of child protection device 11.

In use, child protection device 11 functions in the following manner to monitor the location of a child. First end 15 of strap is advanced into adjustment receptacle 23 until security strap 13 is snugly wrapped around the wrist of child C. Due to the construction of locking mechanism 19, it can be appreciated that child protection device 11 can not be removed from the wrist of child C without possession of the key.

If child C becomes separated from his/her guardian, the guardian can use a telephone T to dial a predetermined pager number which, in turn, accesses child protection device 11. With child protection device 11 accessed, the guardian can then dial a predetermined activation code to enable child protection device 11. With child protection device 11 enabled, speaker 39 of alarm unit 33 produces a recognizable siren, where volume can either be increased by using telephone T, as noted above, or whose volume increases automatically as noted above. Upon locating child C, the siren can be turned off by a dialing a predetermined deactivation code using telephone T or by using a deactivation button (not shown) located so that it can only be accessed when device 11 is removed from the child or by coupling the locking mechanism to an on-off switch (not shown). The deactivation button arrangement could be identical to that shown in U.S. Pat. No. 5,617,074.

Figure 3:
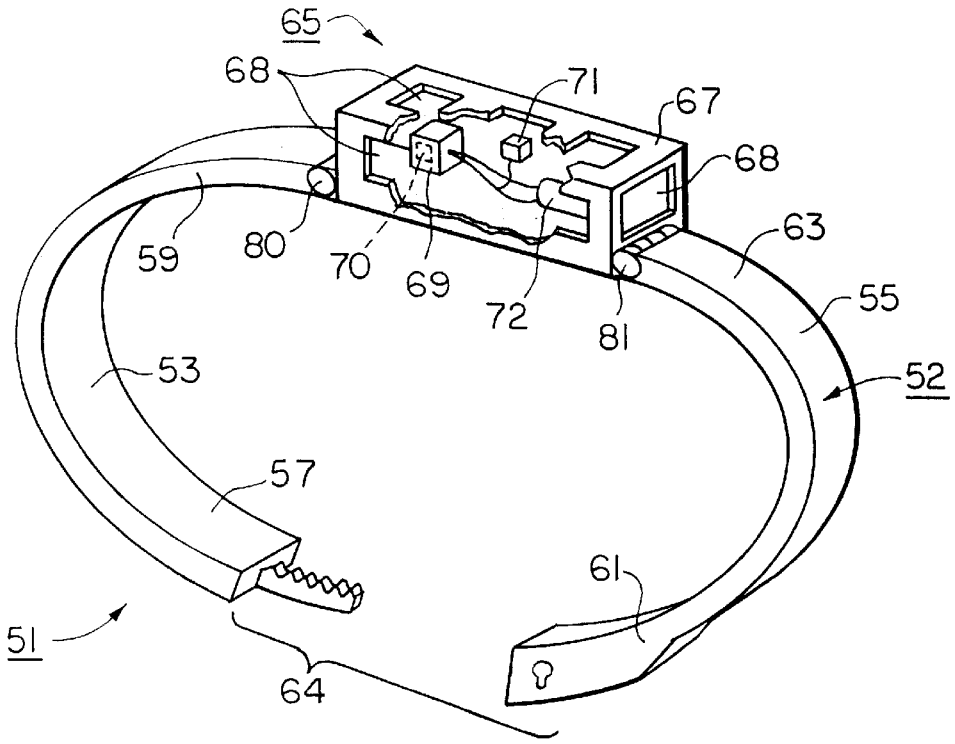
FIG. 3 is a perspective view broken away in part of a second embodiment of a child protection device constructed according to the teachings of the present invention.

Referring now to FIG. 3, there is shown a second embodiment of a child protection device constructed according to the teachings of the present invention, the child protection device being identified generally by reference numeral 51. As will be discussed in detail below, child protection device 51 functions in the same manner as child protection device 11 to enable a guardian to effectively monitor the location of a child.

Child protection device 51 comprises a security strap 52 having first portion 53 and a second portion 55, first portion 53 having a first end 57 and a second end 59 and second portion 55 having a first end 61 and a second end 63. Child protection device 51 is similar to child protection device 11 in that child protection device 51 comprises a locking mechanism 64 identical to locking mechanism 19 for lockably connecting first end 57 of first portion 53 of strap 52 to first end 61 of second portion 55 of strap 52.

Child protection device 51 comprises an alarm unit 65 similar to alarm unit 33. Unit 65 comprises a generally rectangular casing 67 having openings 68, a receiver 69 identical to receiver 37 disposed within casing 67 for detecting an encoded signal, receiver 69 including a processor 70, a 9 volt battery 71 inside casing 67 for powering receiver 69 system-enabling signal and an alarm speaker 72 disposed within casing 67 in electrical connection with receiver 69 for emitting a loud recognizable siren in response to receiver 69 detecting a system-enabling signal. Second end 59 of first strap portion 53 and second end 63 of second strap portion 55 are attached to opposite ends of alarm casing 67 by hinges 80 and 81, respectively. If strap 52 is made of flexible material, hinges 80 and 81 could be eliminated.

It is also to be understood that hinges 80 and 81 could be positioned along any portion of straps 53 and 55 while maintaining their utility. Furthermore, it is to be understood that additional hinges could be incorporated into strap portions 53 and 55 to improve the ease in placing child protection device 51 around the wrist of child C.

Figure 4:
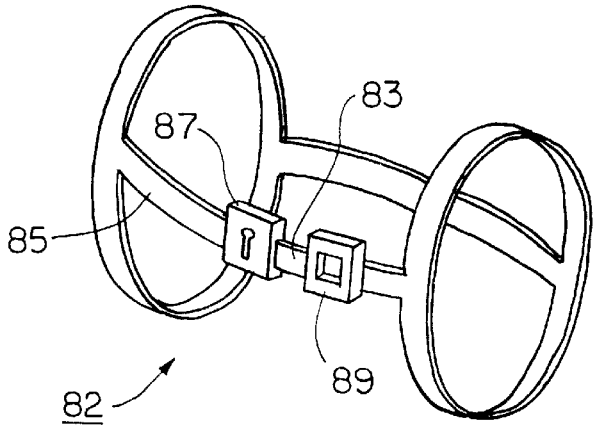
FIG. 4 is a perspective view of a third embodiment of a child protection device constructed according to the teachings of the present invention.

Referring now to FIG. 4, there is shown a third embodiment of a child protection device constructed according to the teachings of the present invention, the child protection device being identified generally by reference numeral 82. As will be discussed in detail below, child protection device 82 functions similarly to child protection device 11 to enable a guardian to effectively monitor the location of a child.

Child protection device 82 differs from child protection device 11 mainly in that child protection device 82 includes a security strap 83 which differs from security strap 13. Security strap 83 is constructed of a high strength nylon or other similar material, similar to strap 13, but is sized and shaped to fit as a harness around the torso of a child. Strap portion 85 includes a key operated adjustment receptacle 87 whose construction is identical to adjustment receptacle 23 while strap portion 87 includes a plurality of adjustment rachet teeth (not shown) identical to teeth 21. Device 82 also includes an alarm unit 89 identical to alarm unit 33 as to its contents.

Figure 5:
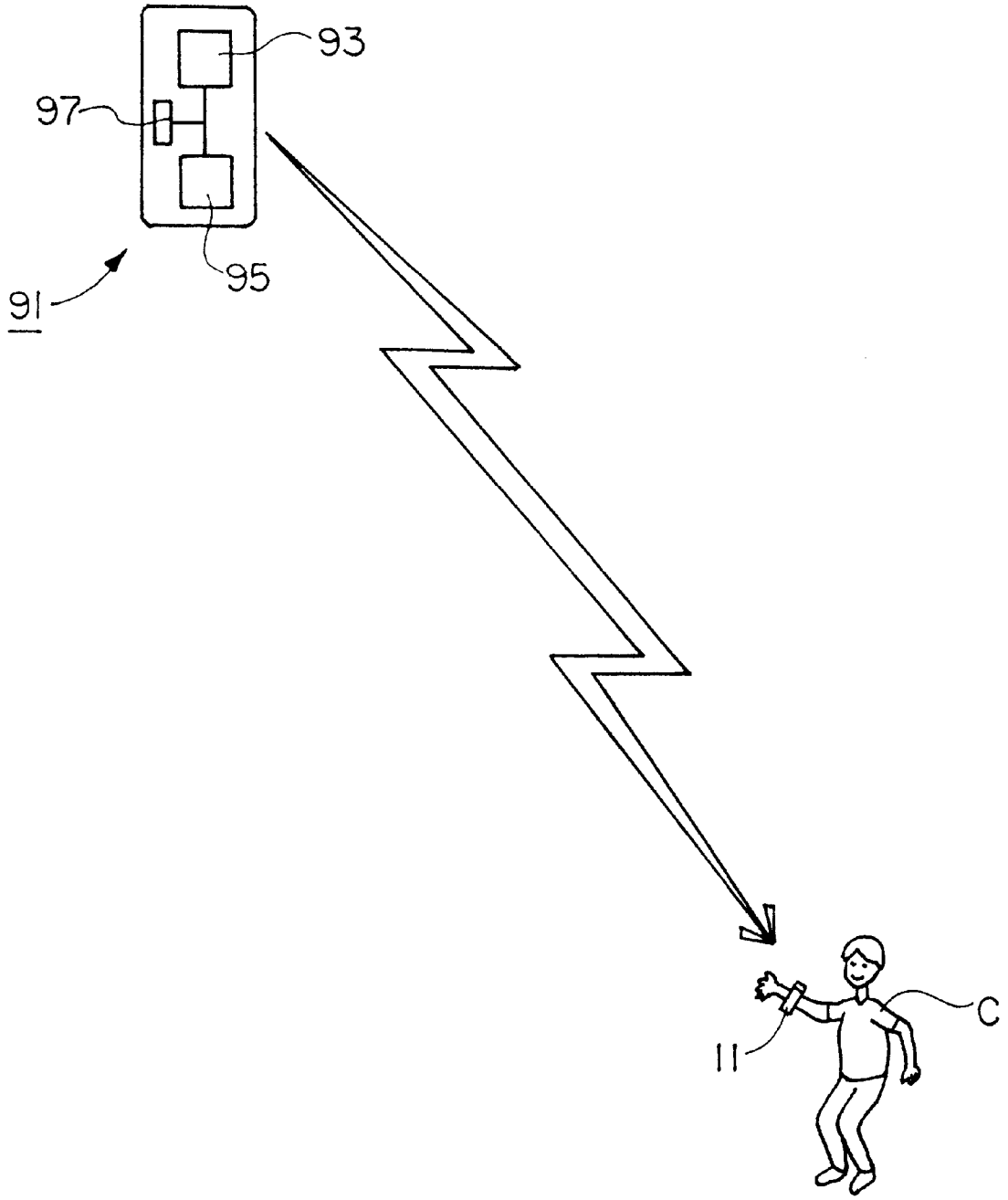
FIG. 5 is a system overview of how the child protection device shown in FIG. 1 could be enabled using a remote activator unit.

Referring now to FIG. 5, there is shown another system using the child protection device of this invention. In FIG. 5, instead of receiving radio frequency signals from a cellular phone type connection as shown in FIG. 2, receiver 37 in unit 33 is constructed so as to receive a radio frequency system-enabling signal directly from a device 91 held by the parent. As shown, device 91 includes an enabling signal transmitter 93, electronics 95 which includes a processor and a battery 97 for powering device 91.

The embodiments shown in the present invention are intended to be merely exemplary and those skilled in the art shall be able to make numerous variations and modifications to it without departing from the spirit of the present invention. For example, instead of a key operated locking mechanism, the locking mechanism could be a combination lock. Also, instead of a speaker, a buzzer or any other type of electrically powered audio signal indicator. All such variations and modifications are intended to be within the scope of the present invention as defined in the appended claims.

What is claimed is:

1. A child protection device comprising:

(a). a strap constructed of a strong, durable and unbreakable material, said strap being sized and shaped to fit around the wrist of a child, (b). a locking mechanism for lockably securing said strap onto the wrist of the child, and (c). an alarm unit comprising, (i). a casing attached to said strap, (ii). a receiver disposed in said casing for detecting a system-enabling signal remotely transmitted through a communication medium, said receiver including a processor, (iii). a battery disposed in said casing for powering said receiver, and (iv). a speaker disposed in said casing in electrical connection with said receiver for emitting an alarm signal in response to said receiver detecting the system-enabling signal, the alarm signal being an approximately 120 decibel siren, wherein the volume of the siren emitted by said speaker can be remotely adjusted through the communication medium.

2. The child detection device as claimed in claim 1 wherein the alarm signal can be tracked in order to determine the location of said child detection device.

3. The child detection device as claimed in claim 2 wherein the trackable alarm signal is a radio frequency signal.

4. The child detection device as claimed in claim 1 wherein the communication medium is a cellular communication medium.

5. The child detection device as claimed in claim 1 wherein said locking mechanism enables said strap to be adjustably fitted snugly around the wrist of the child.

6. The child detection device as claimed in claim 5 wherein said locking mechanism is key operated.

7. A child protection device comprising:

(a). an alarm unit comprising, (i). a casing, (ii). a receiver disposed in said casing for detecting a system-enabling signal remotely transmitted through a communication medium, said receiver including a processor, (iii). a battery for powering said receiver, and (iv). a speaker disposed in said casing in electrical connection with said receiver for emitting an alarm signal in response to said receiver detecting the system-enabling signal, the alarm signal at peak being an approximately 120 decibel siren, wherein the volume of the siren emitted by said speaker can be remotely adjusted through the communication medium, and (b). strap means attached to said alarm casing, said strap means being constructed of a strong, durable and unbreakable material and being sized and shaped to fit as a harness around the torso of a child.

8. The child detection device as claimed in claim 7 wherein the alarm signal can be tracked in order to determine the location of said child detection device.

9. The child detection device as claimed in claim 8 wherein the trackable alarm signal is inaudible to the human ear.

10. The child detection device as claimed in claim 7 wherein the communication medium is a cellular communication medium.

11. A child protection device comprising:

(a). a strap constructed of a strong, durable and unbreakable material, said strap being sized and shaped to fit around the wrist of a child, (b). a locking mechanism for lockably securing said strap onto the wrist of the child, and (c). an alarm unit comprising, (i). a casing attached to said strap, (ii). a receiver disposed in said casing for detecting a system-enabling signal remotely transmitted through a communication medium, said receiver including a processor, (iii). a battery disposed in said casing for powering said receiver, and (iv). a signal emitter disposed in said casing in electrical connection with said receiver for emitting an alarm signal in response to said receiver detecting the system-enabling signal, wherein the volume of the alarm signal emitted by said signal emitter can be remotely adjusted through the communication medium.

12. A child protection device comprising:

(a). an alarm unit comprising, (i). a casing, (ii). a receiver disposed in said casing for detecting a system-enabling signal remotely transmitted through a communication medium, said receiver including a processor, (iii). a battery for powering said receiver, and (iv). a signal emitter disposed in said casing in electrical connection with said receiver for emitting an alarm signal in response to said receiver detecting the system-enabling signal, wherein the volume of the alarm signal emitted by said signal emitter can be remotely adjusted through the communication medium, and (b). strap means attached to said alarm casing, said strap means being constructed of a strong, durable and unbreakable material and being sized and shaped to fit as a harness around the torso of a child.

13. A child protection device comprising:

(a). a strap constructed of a strong, durable and unbreakable material, said strap being sized and shaped to fit around the wrist of a child, (b). a locking mechanism for lockably connecting the first end of said strap to the second end of said strap, and (c). an alarm unit comprising, (i). an alarm casing attached to said strap, (ii). a transceiver disposed in said alarm casing for detecting a system-enabling signal remotely transmitted through a communication medium and emitting an alarm signal in response thereto, wherein the volume of the alarm signal emitted by said transceiver can be remotely adjusted through the communication medium, said transceiver including a processor, and (iii). a battery disposed in said alarm casing for powering said receiver.

14. A personal alarm device comprising:

a. a strap adapted to be attached to a person, and b. an alarm unit on said strap, said alarm unit comprising, i. a receiver for detecting a system enabling signal remotely transmitted through a communication medium and emitting an alarm signal in response thereto, the alarm signal at peak being an approximately, 120 decibel siren and the volume of the alarm signal emitted by said transceiver being remotely adjusted through the communication medium, and ii. a battery for powering said receiver.

* * * * *